US007901567B2

(12) United States Patent
Coupard et al.

(10) Patent No.: US 7,901,567 B2
(45) Date of Patent: Mar. 8, 2011

(54) PROCESS FOR SELECTIVE CAPTURE OF ARSENIC IN GASOLINES RICH IN SULPHUR AND OLEFINS

(75) Inventors: Vincent Coupard, Vaulx-en-Velin (FR); Christophe Bouchy, Lyons (FR); Florent Picard, Communay (FR)

(73) Assignee: IFP Energies Nouvelles, Rueil Malmaison Cedex (FR)

( * ) Notice: Subject to any disclaimer, the term of this patent is extended or adjusted under 35 U.S.C. 154(b) by 71 days.

(21) Appl. No.: 11/664,712

(22) PCT Filed: Oct. 4, 2005

(86) PCT No.: PCT/FR2005/002430

§ 371 (c)(1), (2), (4) Date: Dec. 3, 2007

(87) PCT Pub. No.: WO2006/037884

PCT Pub. Date: Apr. 13, 2006

(65) Prior Publication Data

US 2008/0135455 A1 Jun. 12, 2008

(30) Foreign Application Priority Data

Oct. 6, 2004 (FR) ..... 04 10558

(51) Int. Cl.
*C10G 45/06* (2006.01)
*C10G 29/04* (2006.01)
*B01J 20/02* (2006.01)

(52) U.S. Cl. ..... 208/253; 208/251 R; 208/251 H; 585/820; 502/406; 502/516

(58) Field of Classification Search ..... 208/251 R, 208/251 H, 253; 585/820; 502/406, 407, 502/415, 516

See application file for complete search history.

(56) References Cited

U.S. PATENT DOCUMENTS

| | | | | |
|---|---|---|---|---|
| 4,046,674 | A | 9/1977 | Young et al. | |
| 4,474,896 | A | 10/1984 | Chao et al. | |
| 4,778,588 | A | 10/1988 | Brandes et al. | |
| 5,531,886 | A | 7/1996 | Cameron et al. | |
| 6,033,556 | A | 3/2000 | Didillon et al. | |
| 6,221,241 | B1 * | 4/2001 | Carnell et al. | 208/251 R |
| 6,878,265 | B2 * | 4/2005 | Didillon et al. | 208/251 R |
| 2003/0205504 | A1 * | 11/2003 | Kaminsky et al. | 208/210 |
| 2005/0014639 | A1 * | 1/2005 | Bhan et al. | 502/313 |

FOREIGN PATENT DOCUMENTS

| | | | |
|---|---|---|---|
| EP | 0 357 873 A | | 3/1990 |
| EP | 0 480 603 | * | 4/1992 |
| EP | 0 487 370 A | | 5/1992 |
| EP | 0 611 182 A | | 8/1994 |
| FR | 2 764 214 A | | 12/1998 |

* cited by examiner

*Primary Examiner* — Walter D Griffin
*Assistant Examiner* — Renee Robinson
(74) *Attorney, Agent, or Firm* — Millen, White, Zelano & Branigan, P.C.

(57) ABSTRACT

A process for capturing organometallic impurities comprising at least one of a heavy metal, silicon, phosphorus, and arsenic, contained in a hydrocarbon feed comprising contacting the feed with a capture mass comprising at least one of iron (Fe), cobalt (Co), nickel (Ni), copper (Cu), lead (Pb) and zinc (Zn) deposited on a porous support at least one of aluminas, silica, silica-aluminas, and titanium, or magnesium oxides used alone or as a mixture with alumina or silica-alumina, the metallic element being in the sulphide form with a degree of sulphurization of at least 60%, and in which the feed to be treated is a catalytically cracked gasoline containing 5% to 60% by weight of olefins, 50 ppm to 6000 ppm by weight of sulphur and traces of arsenic in amounts in the range 10 ppb to 1000 ppb by weight.

21 Claims, No Drawings

PROCESS FOR SELECTIVE CAPTURE OF ARSENIC IN GASOLINES RICH IN SULPHUR AND OLEFINS

FIELD OF THE INVENTION

The present invention relates to a capture mass for organometallic impurities such as heavy metals, silicon or phosphorus, and more particularly arsenic in hydrocarbon fractions of the type which is rich in olefins and sulphur, as well as to a process employing said capture mass.

The process of the invention allows the capture of organometallic impurities such as heavy metals, silicon, phosphorus, and more particularly arsenic, under a partial pressure of hydrogen, said pressure being optimized, to limit hydrogenation of olefins and aromatics present in the cut to be treated.

More particularly, the invention is applicable to the treatment of gasoline cuts containing olefins and sulphur, such as gasolines from catalytic cracking, the arsenic in which is to be extracted, without hydrogenating the olefins and the aromatics.

PRIOR ART

Future specifications on automobile fuels envisage a large reduction in the amount of sulphur in fuels, especially in gasolines. In Europe, specifications on sulphur contents are 150 ppm by weight, and will reduce in future to contents of less than 10 ppm after a transition period of 50 ppm by weight.

The change in sulphur content specifications in fuels thus necessitates the development of novel deep desulphurization processes for gasolines.

The principal sources of sulphur in gasoline bases are constituted by cracking gasolines, and principally the gasoline fraction from a process for catalytically cracking an atmospheric distillation residue or a crude oil vacuum distillate.

On average, the gasoline fraction derived from catalytic cracking represents 40% of a gasoline base and contributes more than 90% of the sulphur present in the gasolines.

The production of low sulphur gasoline thus necessitates a step for desulphurizing catalytically cracked gasoline, said desulphurization conventionally being produced by one or more steps for bringing the sulphur-containing compounds contained in said gasoline into contact with a gas which is rich in hydrogen in a process known as hydrodesulphurization.

Further, the octane number of said gasoline is very strongly linked to their olefins and aromatics content.

Preserving the octane number of such gasoline necessitates limiting olefin transformation and aromatic hydrogenation reactions.

Further, the hydrodesulphurization process must generally be carried out in an uninterrupted manner for periods of 3 to 5 years.

The catalysts used to carry out hydrodesulphurization of sulphur-containing gasoline must thus have good activity and good stability to be capable of being operated continuously for several years.

However, the presence of heavy metals such as mercury or arsenic, or contaminants such as phosphorus or silicon in the form of organometallics, in the hydrocarbon feeds to be desulphurized causes a rapid deactivation of the hydrotreatment catalysts.

Various solutions have been proposed in the literature to extract such compounds and more particularly arsenic from hydrocarbon fractions. However, none of those solutions is in fact suitable for selective extraction of heavy metals such as arsenic in the presence of olefins, while limiting the hydrogenation reactions responsible in this context for reducing the octane number of the gasoline concerned.

U.S. Pat. No. 4,046,674 describes a process for eliminating arsenic using a capture mass containing at least one nickel compound in the sulphide form in a quantity in the range 30% to 70% by weight (with respect to the NiO form), and at least one molybdenum compound, also in the sulphide form, in a quantity in the range 2% to 20% by weight (with respect to the $MoO_3$).

The capture mass of the present invention contains no molybdenum.

French patent FR-A-2 617 497 describes a process for eliminating arsenic from hydrocarbon cuts by bringing them into contact with a catalyst containing nickel at least 50% by weight of which is in the metal form.

The skilled person will be aware of the hydrogenating properties of Ni and thus will expect that the direct application of such a catalyst would lead to hydrogenation to a greater or less extent of a large proportion of the olefins present in the hydrocarbon cut to be treated, which would not appear to overcome the problems which the present invention seeks to resolve.

European patents EP-B1-0 611 182 and EP-B 0 611 183 describe a process for eliminating arsenic using a capture mass containing at least one metal from the nickel, cobalt, molybdenum, tungsten, chromium and palladium group. Contact with the feed is carried out in hydrogen at a temperature in the range 120° C. to 250° C., at a pressure in the range 0.1 MPa to 4 MPa, and at a space velocity in the range 1 $h^{-1}$ to 50 $h^{-1}$.

The text of the patent states that at least 5% and at most 50% of the metal must be in the form of the sulphide.

The capture mass of the present invention has a degree of sulphurization of more than 60% and preferably more than 70%.

FR-A-2 764 214 describes the preparation of a catalyst in the form of extrudates containing an oxide or a sulphide of different metals including nickel. However, the mode used to sulphurize said catalyst is not detailed. Further, it is described that that type of capture mass can also produce hydrogenation reactions, which does not answer the problem that we are seeking to solve. Finally, that patent teaches the use of a capture mass obtained from reduced Ni, without mentioning the use of core-sulphurized nickel.

U.S. Pat. No. 6,759,364 describes a catalyst adapted to the capture of arsenic in naphtha or distillate cuts derived from the distillation of crude oil, which contains nickel, molybdenum and phosphorus. The capture mass of the present invention contains no molybdenum.

The article "Removal of arsenic and mercury from crude oil by surface organometallic chemistry on metals; mechanism of $AsPh_3$ and $HgPh_2$ interaction with $Ni/Al_2O_3$ and $NiS/Al_2O_3$", Candy et al, in Oficyna Wydawnicza Politechniki Wroclawskiej (2002), 57, 101-108, shows that the use of a catalyst based on partially sulphurized nickel (denoted "NiS") is not advantageous compared with a catalyst based on Ni reduced at temperatures of 443K (about 170° C.). The teaching of that article thus does not incite the skilled person to use a sulphurized form of nickel as the capture mass for arsenic.

BRIEF DESCRIPTION OF THE INVENTION

The solution proposed by the applicants consists of using a catalyst (also termed the capture mass in the remainder of the text) comprising at least one metallic element selected from the group constituted by iron (Fe), cobalt (Co), nickel (Ni), copper (Cu), lead (Pb) or zinc (Zn), said metallic element preferably being Ni. The catalyst support is normally a porous solid selected from the group constituted by aluminas, silica, silica-aluminas or oxides of titanium or magnesium, used alone or as a mixture with alumina or silica-alumina.

The metals are used in the sulphide form, with a degree of sulphurization of at least 60%, preferably at least 70%.

It has surprisingly been discovered that using said catalysts, in a temperature range of 200° C. to 350° C., and at a partial pressure of hydrogen such that the ratio of the hydrogen flow rate to the feed flow rate is in the range 50 normal $m^3/m^3$ to 800 normal $m^3/m^3$, can capture arsenic contained in a gasoline containing olefins and sulphur, while limiting the degree of olefin hydrogenation to values which are generally below 30%, preferably less than 20% and more preferably less than 10%.

Since olefins are hydrogenated more easily than aromatic compounds, the present invention also does not substantially hydrogenate aromatic compounds.

Thus, the present invention can be defined as concerning a capture mass for organometallic impurities such as heavy metals, silicon or phosphorus, and more particularly arsenic, in a hydrocarbon feed containing olefins, comprising at least one metallic element selected from the group constituted by iron (Fe), cobalt (Co), nickel (Ni), copper (Cu), lead (Pb) and zinc (Zn), deposited on a porous support selected from the group constituted by aluminas, silica, silica-aluminas or oxides of titanium or magnesium, used alone or as a mixture with alumina or silica-alumina, the metallic element being in the sulphide form with a degree of sulphurization of at least 60% and preferably more than 70%.

The invention also concerns a process for capturing organometallic impurities such as heavy metals, silicon or phosphorus, and more particularly arsenic contained in a hydrocarbon feed employing a capture mass as defined above, in which said capture mass is brought into contact with the feed to be treated and a stream of hydrogen in a manner such that the ratio of the hydrogen flow rate to the feed to be treated under the reaction conditions is in the range 50 to 800, preferably in the range 100 to 600 and more preferably in the range 200 to 400 by volume.

DETAILED DESCRIPTION OF THE INVENTION

The feeds treated are hydrocarbon fractions containing various heavy metals, and in particular arsenic in amounts which are generally in the range 10 ppb to 1000 ppb (1000 ppb=1 ppm, i.e. one part per million), containing at least 5% of olefins and at least 30 ppm of sulphur. The values given in ppm or ppb in this description are ppm and ppb expressed by weight.

More particularly, the invention is applicable to the treatment of gasoline cuts derived from cracking units or to gasoline mixtures containing olefin-rich gasolines.

The cracking gasolines may be derived from catalytic cracking, thermal cracking or steam cracking units.

The invention is also applicable to the treatment of mixtures of straight run gasolines which may contain heavy metals derived from crude oil, with cracking gasolines containing olefins.

However, the invention is preferably also applicable to catalytically cracked gasolines which may contain between 5% and 60% by weight of olefins, 50 ppm to 6000 ppm of sulphur, as well as traces of arsenic in amounts which are generally in the range 10 ppb to 1000 ppb.

Thus, extracting arsenic from said gasolines necessitates the development of a selective process which can achieve a controlled degree of olefin hydrogenation. In the context of the present invention, said degree of hydrogenation is less than 30%, preferably less than 20%, and more preferably less than 10%. The degree of hydrogenation of the aromatic compounds is less than 10%.

The capture masses of the invention are solids comprising at least one metallic element selected from the group constituted by Fe, Co, Ni, Cu, Ph or Zn.

The catalyst support is normally a porous solid selected from the group constituted by aluminas, silica, silica-aluminas or oxides of titanium or magnesium, used alone or as a mixture with alumina or silica-alumina.

The support should have a large specific surface area of at least more than 30 $m^2/g$, preferably in the range 50 $m^2/g$ to 350 $m^2/g$, as measured by the BET method (ASTM standard D3663).

The support should also have a pore volume (measured by mercury porosimetry using ASTM D4284-92 with a wetting angle of 140°) of at least 0.3 $cm^3/g$, and preferably in the range 0.3 $cm^3/g$ to 1.2 $cm^3/g$, as well as a mean pore diameter (corresponding to an intrusion volume of $V_p(Hg)/2$) of at least 5 nm (nm is the abbreviation for nanometer=$10^{-9}$ metre), preferably more than 7 nm, and more preferably in the range 7 to 50 nm.

The Applicant has surprisingly discovered that the elements Fe, Co, Ni, Cu, Pb, Zn, used alone or as a mixture, must be substantially sulphurized before using the capture mass.

Said sulphurization can ensure effective capture of As, and possibly of phosphorus and silicon of the feed, with a degree of hydrogenation which is limited to olefins and aromatics present in the feed to be treated.

An element is considered to be substantially sulphurized when the mole ratio between the sulphur (S) present on the capture mass and said element is at least 60% of the theoretical molar ratio corresponding to total sulphurization of the element under consideration:

$$(S/element)_{capture} \geqq 0.6 \times (S/element)_{theoretical}$$

where:

$(S/element)_{capture}$ is the mole ratio between the sulphur (S) and the element present on the capture mass;

$(S/element)_{theoretical}$ is the mole ratio between the sulphur and the element corresponding to total sulphurization of the element to the sulphide.

Said theoretical mole ratio varies depending on the element under consideration:

$(S/Fe)_{theoretical}=1$ $(S/Co)_{theoretical}=8/9$ $(S/Ni)_{theoretical}=2/3$ $(S/Cu)_{theoretical}=1/2$ $(S/Pb)_{theoretical}=1$ $(S/Zn)_{theoretical}=1$ When the capture mass comprises several elements, the mole ratio between the S present on the capture mass and the set of elements must also be at least 60% of the theoretical mole ratio corresponding to total sulphurization of each element to sulphide, the computation being carried out pro rata for the relative mole fractions of each element.

As an example, for a capture mass comprising iron and nickel with a respective mole fraction of 0.4 to 0.6, the minimum mole ratio (S/Fe+Ni) is given by the relationship:

$$(S/Fe+Ni)_{capture}=0.6\times\{(0.4\times1)+(0.6\times(2/3)\}$$

The capture mass of the invention may be prepared using any technique known to the skilled person, and especially by the dry impregnation method.

The method for preparing the capture mass is in no case a limiting feature of the present invention.

As an example, one possible preparation method, termed the dry impregnation method, consists of dissolving exactly the quantity of metallic elements desired to form salts which are soluble in the selected solvent, for example demineralized water, and to fill as exactly as possible the pores of the support with the prepared solution.

Before the sulphurization step, the solid obtained may undergo a drying and/or calcining and/or reduction step.

Preferably, the solid undergoes a drying step, optionally followed by a calcining step.

The capture mass then undergoes a sulphurization step using any method which is known to the skilled person.

Generally, sulphurization is carried out using a heat treatment of the capture mass in contact with hydrogen, and a sulphur-containing organic compound which is decomposable and a generator of $H_2S$, such as DMDS (dimethyldisulphide), or directly in contact with a flow of $H_2S$ gas and hydrogen.

Said step is carried out inside (in situ) or outside (ex situ) at temperatures in the range 100° C. to 600° C., and preferably at temperatures in the range 200° C. to 500° C.

In a particular implementation of the invention, sulphurization may also be carried out during heavy metal capture, i.e. during the process itself. In this case, the catalyst is charged in the form of an oxide and is brought into contact with the feed to be treated under the reaction conditions.

The $H_2S$ generated by partial decomposition of sulphur-containing compounds of the feed can sulphurize the catalyst, i.e. transform metallic oxides to metallic sulphides.

Several reactor technologies may be envisaged to carry out capture, the most conventional and the most widely used technique being the fixed bed technique. In this case, a reactor is charged with capture mass, and functions for a certain time in capture mode, in principle until the appearance of As in the outlet effluent (a phenomenon known as breakthrough), then enters the regeneration phase.

In certain cases the total quantity of poisoned adsorbent mass may be replaced by an equivalent fresh quantity. The choice of a regeneration or lost capture mass technique depends on the rate of deactivation of said capture mass, but is not considered in the context of the present invention as a limiting feature.

The capture mass is either used in the form of an oxide, or sulphurized in situ or ex situ.

Other techniques may also be envisaged.

The capture mass may be employed in a moving bed reactor, i.e. the used mass is continuously extracted and replaced by fresh mass. That type of technique can maintain the capacity of the capture mass and avoid arsenic breakthrough.

Other solutions which may be cited are the use of expanded bed reactors which can also allow continuous extraction and makeup of catalysts to maintain the activity of the capture mass.

In order to be active in capturing arsenious compounds and compounds containing phosphorus and silicon, the capture mass must be used under operating conditions such that the rate of decomposition and capture of the arsenic, and optionally phosphorus and silicon, are maximized, while limiting the rate of olefin hydrogenation.

To this end, a flow of hydrogen is mixed with the feed in proportions so that the ratio of the flow rates of hydrogen to the feed flow rate is in the range 50 to 800 $Nm^3/m^3$, preferably in the range 100 to 600 $Nm^3/m^3$, and more preferably in the range 200 to 400 $Nm^3/m^3$.

The hydrogen used may be any source of hydrogen, but preferably either fresh hydrogen from the refinery or recycled hydrogen from a hydrodesulphurization unit or a hydrodesulphurization unit for the hydrocarbon cut to be purified, or a mixture of the two.

The consumption of hydrogen in the capture step is very low, as hydrogen is principally consumed by olefin hydrogenation which is precisely maintained at a level of 30% or less, preferably less than 20% by weight, and more preferably less than 10% by weight.

The excess hydrogen is thus either conserved as a mixture with the flow rate of hydrocarbons, the resulting flow being directly injected, for example, into the hydrodesulphurization reactor, or separated and recycled after cooling the effluent from the capture unit.

The operating temperature of the reactors is in the range 200° C. to 350° C., preferably in the range 230° C. to 340° C. and more preferably in the range 260° C. to 330° C.

The pressure is generally in the range 0.2 MPa to 5 MPa, preferably in the range 0.5 MPa to 3 MPa.

The quantity of capture mass employed is calculated as a function of the amount of contaminants in the feed and the desired service life. However, if the quantity of capture mass is low, it is advantageous to operate in the high temperature, pressure and hydrogen flow rate range to improve the rate of decomposition of the arsenious compounds.

When the capture mass is used upstream of a hydrodesulphurization unit, it is advantageous to operate the capture step under the same pressure, temperature and hydrogen flow rate conditions as those of said hydrodesulphurization unit. This allows the capture mass to be placed directly in the hydrodesulphurization reactor, in the guard bed position.

COMPARATIVE EXAMPLE

The example described below compares a series of prior art catalysts (catalysts A, B, C, D2 and D3) with a catalyst of the invention (catalyst D1).

These catalysts were compared using two criteria: hydrogenating activity and an arsenic capture criteria.

The various test catalysts were obtained as follows:

Catalyst A was a catalyst based on cobalt and molybdenum deposited on alumina sold under reference number HR306 (trade name of Axens). Catalyst A was core sulphurized as follows: 2 to 6 grams of catalyst were heat treated at atmospheric pressure in a flow of a mixture of $H_2S$ and $H_2$ gas (15% vol $H_2S$) at an hourly space velocity of 1 l/h gram of catalyst, at 400° C. for two hours. The temperature ramp-up was typically in the range 2° C./min to 10° C./min.

Catalyst B was a catalyst based on nickel, molybdenum and phosphorus deposited on gamma alumina by impregnating said alumina as disclosed in U.S. Pat. No. 6,759,364 (Example 1). The nickel, molybdenum and phosphorus contents were respectively 9.6, 12.0 and 2.0% by weight on that catalyst. Catalyst B was core sulphurized using the procedure described for catalyst A.

Catalyst C was a catalyst based on nickel and molybdenum on alumina sold under reference HR945 (Axens); catalyst C was core sulphurized using the procedure described for catalyst A.

Catalyst D was a catalyst based on nickel on alumina. It was prepared from a macroporous alumina support with a specific surface area of 160 $m^2/g$, impregnated by dry impregnation with 20% by weight of nickel in the form of an aqueous nitrate solution. After drying at 120° C. for 5 hours, and heat activation at 450° C. for 2 hours in a stream of air, beads containing 25.4% by weight of nickel oxide were obtained.

Catalyst D1 was prepared from catalyst D by core sulphurization using the procedure described for catalyst A.

Catalyst D2 was produced from solid D reduced in a reduction bed at 400° C. in a flow of 20 l/h of hydrogen at 2 bars for 4 hours.

Catalyst D3 was prepared from catalyst D using the following procedure: 100 g of catalyst D was impregnated with a solution containing 3.5 g of diethanoldisulphide (including 1.45 g of sulphur) in a solution of 15% by weight of methyl formate in a hydrocarbon cut known as "white spirit". The prepared catalyst D3 was activated in a stream of nitrogen at 150° C. for 1 hour.

Catalysts A, B and C contained molybdenum and thus were not in accordance with the invention.

Catalysts D2 and D3 contained no molybdenum but had degrees of sulphurization of less than 60% and were thus not in accordance with the invention.

1) Evaluation of Hydrogenating Activity

The hydrogenating activity of the various catalysts was determined using a mixture of model molecules, in a 500 ml stirred autoclave reactor containing 4 grams of test catalyst.

The model feed used for the hydrogenating activity test had the following composition:

1000 ppm of sulphur in the form of thiophene;

10% by weight of olefins in the form of 2,3-dimethyl-2-butene in n-heptane.

The total pressure was kept at 3.5 MPa relative by adding hydrogen and the temperature was adjusted to 250° C.

At time t=0, the capture mass was brought into contact with the reaction medium.

Periodically, samples were removed to monitor the change in composition of the solution over time by gas phase chromatographic analysis.

The test duration was selected so as to obtain degrees of olefin hydrogenation in the range 20% to 50%.

The hydrogenating activity of the capture mass was defined as the ratio of the olefin hydrogenation rate constant per volume of capture mass. The rate constant was calculated by assuming that the following reaction was of first order:

$$A(HYD)=k/(m_{capture}\times SPD_{capture})$$

in which:

A(HYD) denotes the hydrogenating activity of the capture mass, in $min^{-1}\ cc_{capture}^{-1}$;

k: rate constant for olefin hydrogenation;

$M_{capture}$: capture mass used, in grams (before heat treatment);

$SPD_{capture}$: packed filling density of capture mass, in $cm^3/g$ (before heat treatment).

The sulphur content in each prepared catalyst was measured by elemental analysis.

The degree of sulphurization was defined as the ratio between the (S/metals) ratio of the catalyst and the (S/metals) theoretical ratio corresponding to complete sulphurization of the catalyst metals.

With the molybdenum-containing catalysts, the theoretical molar ratio under consideration was 2(S/Mo=2).

The hydrogenating activity of the various catalysts was measured using the procedure described above.

Table 1 summarizes the results of these analyses.

TABLE 1

| | Catalyst | | | | | |
|---|---|---|---|---|---|---|
| | A | B | C | D3 | D2 | D1 |
| Degree of sulphurization* | 84% | 87% | 83% | 17% | 0 | 94% |
| Hydrogenating activity | 2.3 | 4.2 | 3.6 | 5.1 | 12.2 | 0.1 |

At the end of this first comparison step, it was clear that the two least hydrogenating catalysts were catalyst A (not in accordance with the invention) and catalyst D1 (in accordance with the invention).

2) Arsenic Capture Efficacy at 280° C.

The two catalysts selected after the hydrogenating activity determination, i.e. A and D1, were then evaluated on a real feed doped with arsenious compounds, to measure the arsenic capture efficacy and the hydrogenating activity under operating conditions for capture.

The test was carried out under the following conditions:

T=280° C.

P=2 MPa $H_2$/HC=300 litres/litre

HSV: 4 $h^{-1}$ (litres per litre per hour).

The treated feed was an olefinic gasoline from a catalytic cracking unit.

Said gasoline had been depentanized to treat only the $C_6$+ fraction for hydrodesulphurization.

That gasoline contained 425 ppm of sulphur including 6 ppm of sulphur in the form of mercaptans, and a bromine index, measured using the ASTM D1159-98 standard, of 49 g/100 g.

The cut points for this gasoline A were determined by simulated distillation:

The 5% by weight and 95% by weight distilled points were respectively 61° C. and 229° C.

This gasoline had been doped with 700 ppb by weight of arsenic in the form of triphenylarsine.

The test duration was 168 hours.

After 168 hours of test, a sample of the treated gasoline was analyzed to measure the amounts of arsenic, and olefins by the bromine index method (IBr).

The results are summarized in Table 2 below.

TABLE 2

| | Catalyst | |
|---|---|---|
| | A | D1 |
| Arsenic, micrograms/l | <5 | <5 |
| IBr, g/100 g | 26 | 45 |

There was no arsenic breakthrough for either of the retained catalysts, since the amounts of arsenic measured in the formulations were below the detection limit of the method (<5 micrograms/l).

In contrast, catalyst A caused substantial olefin hydrogenation since the bromine index was only 26 g/100 g at the end of the test.

Since catalyst A is the least hydrogenating of catalysts A, B, C, D2 and D3, as determined in the first step of the test, it can be deduced that those catalysts would have caused a significantly greater loss of olefins under the same test conditions.

Catalyst D1 is thus the only one of the test series which can capture arsenic, while preserving the olefins.

The invention claimed is:

1. A process for capturing organometallic impurities comprising at least one of a heavy metal, silicon, phosphorous, and arsenic, contained in a hydrocarbon feed, comprising contacting the feed with a capture mass consisting essentially of at least one metallic element in catalytic amounts selected from the group consisting of iron (Fe), cobalt (Co), nickel (Ni), copper (Cu), lead (Pb) and zinc (Zn) deposited on a porous support selected from at least one of aluminas, silica, silica-alumina, and titanium, or magnesium oxides used alone or as a mixture with alumina or silica-alumina, the metallic element prior to said contacting being in the sulphide form with a degree of sulphurization of at least 60%, and in which the feed to be treated is a catalytically cracked gasoline containing 5% to 60% by weight of olefins, 50 ppm to 6000 ppm by weight of sulfur and traces of arsenic in amounts in the range 10 ppb to 1000 ppb by weight, wherein said capture mass is core-sulphurized, wherein said capture mass is brought into contact with the feed to be treated and a stream of hydrogen in a manner such that the volume ratio of the hydrogen stream to the feed to be treated under the reaction conditions is in the range of 50 to 800 $Nm^3/m^3$, wherein in the feed the degree of hydrogenation of the olefins is less than 30% and the degree of hydrogenation of aromatic compounds is less than 10%, and wherein the resultant treated feed has a lower degree of hydrogenation of the olefins than that resulting from the use of a comparable catalyst containing molybdenum in addition to said at least one metallic element, and while reducing the arsenic content to less than 5 mircograms per liter.

2. A process according to claim 1, in which the specific surface area of said capture mass is more than 30 $m^2/g$.

3. A process according to claim 2, wherein the specific surface area of said capture mass is in the range 50 $m^2/g$ to 350 $m^2/g$.

4. A process according to claim 1, in which the pore volume of said capture mass is in the range of 0.3 $cm^3$/gram to 1.2 $cm^3$/gram.

5. A process according to claim 1, in which the pore diameter of said capture mass is more than 5 nanometers.

6. A process according to claim 5, wherein the pore diameter of the capture mass is more than 7 nanometers.

7. A process according to claim 5, wherein the pore diameter of the capture is in the range of 7 to 50 nanometers.

8. A process according to claim 1, in which the metallic element deposited on an alumina or silica-alumina support is nickel.

9. A process according to claim 8, wherein the degree of sulphurization of the at least one metallic element is at least 70%.

10. A process according to claim 9, wherein the degree of sulphurization of nickel is on the order of about 94% and wherein the support consists of alumina.

11. A process according to claim 1, in which said capture mass is brought into contact with the feed to be treated and a stream of hydrogen in a manner such that the volume ratio of the hydrogen stream to the feed to be treated under the reaction conditions is in the range of 100 to 600.

12. A process according to claim 11, wherein the volume nature of the hydrogen stream to the feed to be treated under the reaction conditions is in the range of 200 to 400.

13. A process according to claim 1, in which the operating temperature is in the range of 200° C. to 350° C., and the operating pressure is in the range of 0.2 to 5 MPa.

14. A process according to claim 13, wherein the operating temperature is in the range of 260° C. to 330° C., and the pressure is in the range of 0.5 MPa to 3 MPa.

15. A process according to claim 1, in which said capture mass is placed in a reactor located upstream of a hydrodesulphurization unit for said feed.

16. A process according to claim 1, in which said capture mass is placed inside a reactor for hydrodesulphurization of said feed, at the head of said reactor, and operates under the same operating conditions as those for hydrodesulphurization.

17. A process according to claim 1, in which the resultant degree of hydrogenation of the olefins in the feed is less than 20%.

18. A process according to claim 17, wherein the degree of hydrogenation of the olefins in the feed is less than 10%.

19. A process according to claim 1, wherein said metallic element is sulphurized to a degree of more than 70%.

20. A process according to claim 1, wherein the degree of sulphurization of the at least one metallic element is at least 70%.

21. A process according to claim 1, wherein the porous support consists of at least one of aluminas, silica, silica-alumina, titanium oxide, magnesium oxide, and mixtures thereof.

* * * * *